United States Patent [19]

Schmitt et al.

[11] 4,181,619

[45] Jan. 1, 1980

[54] ANTIWEAR COMPOSITION

[75] Inventors: Robert H. Schmitt, Woodbury; Ronald J. Poole, Mullica Hill, both of N.J.

[73] Assignee: Mobil Oil Corporation, New York, N.Y.

[21] Appl. No.: 955,860

[22] Filed: Oct. 30, 1978

[51] Int. Cl.[2] ..... C10M 1/46; C10M 1/40; C10M 3/40; C10M 3/34

[52] U.S. Cl. ..... 252/32.5; 252/33; 252/75; 252/389 A

[58] Field of Search ..... 252/32.5, 33, 75, 389 A

[56] References Cited

U.S. PATENT DOCUMENTS

| | | | |
|---|---|---|---|
| 3,562,159 | 2/1971 | Mastin | 252/33 |
| 3,899,432 | 8/1975 | Rothert et al. | 252/33 |
| 3,969,237 | 7/1976 | Andress | 252/32.5 |
| 3,986,967 | 10/1976 | Okorodudu | 252/32.5 |
| 4,144,180 | 3/1979 | Andress | 252/32.5 |

*Primary Examiner*—Irving Vaughn
*Attorney, Agent, or Firm*—Charles A. Huggett; Raymond W. Barclay; Howard M. Flournoy

[57] ABSTRACT

Hydraulic fluids containing the reaction product of benzotriazole and tricresyl phosphate are stabilized by the addition thereto of minor amounts of calcium dinonyl naphthalene sulfonate and calcium alkyl phenate. Such fluids and other oleaginous compositions containing the above-described novel additive combination are thus provided with good corrosion control, rust protection and improved cleanliness plus antiwear protection.

10 Claims, No Drawings

ANTIWEAR COMPOSITION

BACKGROUND OF THE INVENTION

1. Field of the Invention

This application is directed to a novel antiwear composition and to a method of using same, particularly in multimetal lubricant systems.

2. Summary of the Prior Art

Benzotriazole is a well-known additive to lubricants, to power train fluids and to anti-freeze solutions. It is known, for example that benzotriazole can be utilized in a lubricating oil as a corrosion inhibitor. Benzotriazle has been mixed with other materials such as phenol, an amine, a polyhydroxyquinone, an amine salt and an organic phosphite to produce an antioxidant for polyglycol based lubricants. The use of phosphorus compounds, per se, as EP agents in lubricants is well known.

The use of organic phosphorus compounds in combination with, for example, hindered phenols to produce load carrying additives for lubricants is known from U.S. Pat. No. 3,471,404. Traditionally, antiwear hydraulic oils have been formulated with, e.g., zinc dithiophosphate to provide antiwear protection. However, some newer machines require better multimetal (bronze and aluminum) compatibility than provided by conventional phosphate hydraulic oils which tend to chemically attack these components. U.S. Pat. 3,004,917 discloses the additive combination of calcium dinonyl naphthalene sulfonates and "metal" salts broadly and U.S. Pat. 2,954,344 discloses a combination of hydrocarbon sulfonates and calcium alkyl phenates. It has been found that combinations of the above-described materials perform their expected functions but are generally emulsive and do not permit separation of contaminant water.

So far as is known to applicants, no art is available which discloses the reaction product of benzotriazole with an organophosphorus compound/and its use with calcium dinonyl naphthalene sulfonate and calcium alkyl phenate to provide, inter alia, improved antiwear properties.

SUMMARY OF THE INVENTION

This invention is directed to the novel additive combination of (A) the reaction product of benzotriazole and tricresyl phosphate in combination with (B) calcium dinonyl naphthalene sulfonate and calcium alkyl phenate. This application is further directed to a method of providing antiwear protection, corrosion control, rust protection and keep-clean performance as well as improved antiwear characteristics for lubricant compositions. Therefore, this invention in a more particular aspect, is directed to antiwear lubricant compositions containing a major proportion of a lubricant, e.g., an oil of lubricating viscosity and a minor effective amount of the novel additive combination described and claimed herein. Excellent multimetal compatibility in a variety of situations, e.g., high-performance hydraulic pumps using diverse metalurgies, is achieved.

DESCRIPTION OF SPECIFIC EMBODIMENTS

The benzotriazole derived compounds of this invention can be prepared in a number of ways. One convenient method involves the reaction of benzotriazole directly with tricresyl phosphate in the following manner:

About 4% weight benzotriazole is added to 96% weight tricresyl phosphate in a suitable reaction zone.

This mixture is heated to at least 210° F. (99° C.) with stirring until the solid benzotriazole is completely dissolved (approximately one hour). The BZT/TCP reaction product is thereafter separated and recovered as a liquid. Caveat: Heating this mixture at temperatures below 210° F. can cause benzotriazole to precipitate out of the liquid product, particularly when stored cold. Preferred reaction temperatures are from 210° F. to 300° F. The general structure of the benzotriazole/tricresyl phosphate compounds so prepared are not precisely known, but they are adducts or complexes of benzotriazole and tricresyl phosphate.

The calcium di-nonyl naphthalene synthetic sulfonate is conveniently available from commercial sources. However, care must be taken that the sulfonate so obtained is synthetically made from di-nonyl naphthalene instead of alkylated benzene (synthetic) or selected petroleum fractions (natural). Also available commercially is the calcium alkyl phenate. One highly useful commercial phenate is conveniently prepared from propylene tetramer. Although the alkyl phenate may be prepared from, for example, a polyolefin no carbon to carbon unsaturation exists in the alkyl phenate itself.

As stated hereinabove, the novel additive combination of this invention may be used in mineral oils, mineral oil fractions, synthetic oil and mixed mineral synthetic base stock and may be incorporated into any known lubricating media. This can include oils of lubricating viscosity and also greases in which the aforementioned oils are employed as vehicles; said oils may be functional fluids such as hydraulic oils and various automotive fluids, power steering fluid, brake fluid, transmission fluid and various other such functional fluids. In general, synthetic oils alone or in combination with mineral oils, or as grease vehicles can be effectively utilized herein. Typical synthetic vehicles include polyisobutylene, polybutenes, hydrogenated polydecenes, polypropylene glycol, polyethylene glycol, trimethylol propane esters, neopentyl and pentaerythritol esters, di(2-ethyl hexyl) sebacate, di(2-ethyl hexyl) adipate, dibutyl phthalate, fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted di-phenyl ethers typified by a butyl-substituted bis-(p-phenoxy phenyl) ether and phenoxy phenylether.

It is preferable that the additive components are separately reacted and mixed prior to formulating the novel additive package comprising benzotriazole/aryl phosphate and calcium di-nonyl sulfonate/calcium alkyl phenate. However, the additive package may be prepared in situ, that is by adding proper proportions and/or ratios directly to the lubricant medium.

The preferred concentrations and ratios of calcium di-nonyl sulfonate to calcium alkyl phenate (component B) are one part of calcium sulfonate to one part of calcium phenate. In compositions requiring a dispersant, it is preferable to use one part each of sulfonate and phenate to three parts dispersant. The sulfonate concentration with respect to the phenate concentration may vary conveniently from 0.3 to 1.0 wt. % and the phenate concentration may vary from 0.09 to 0.85 wt. %. All weight percentages are based on the total weight of the compositions. In other words, the ratio of sulfonate to phenate can vary from 1:1 to 9:1 with the proviso that the ratio of sulfonate to phenate is at least 1:1 or more.

The concentrations and ratios of component A to component B are from 0.5–1.5 to 1.0 wt. % with 0.5 to 1.0 wt. % being preferred.

The overall concentration of the additive package embodied herein may vary from about 0.05 to about 10% by weight. Optimum performance characteristics are evidenced by lubricants containing from about 0.25% to about 2% by weight of the additives of this invention, and this is the preferred range of concentration.

Various other additives may also be present in the composition in amounts from 0.001 to 10 wt. % based on the total weight of the final composition.

The oil of lubricating viscosity, for example a hydraulic oil, is stabilized by the combination of calcium dinonyl naphthalene sulfonate and calcium alkyl phenate. This stabilizer imparts thin oil film rust inhibition and keep-clean performance to for example hydraulic systems. Benzotriazole is normally oil insoluble at the dosage needed for good corrosion control. Reacting it with tricresyl phosphate produces a clear antiwear concentrate which is readily soluble in the finished product.

Having defined the invention in general terms, the following examples are offered as illustrations and as such are not to be construed as limitations of the invention.

EXAMPLE 1

To a mixture of solvent refined paraffinic neutral stock totaling about 97.69 wt. % was added 1.0 wt. % (0.4 and 0.6) of calcium di-nonyl naphthalene sulfonate and calcium alkyl phenate plus 0.50 wt. % of the benzotriazole (BZT)/tricresyl phosphate (TCP) reaction product (96 wt. % TCP+4 wt. % BZT) prepared as described hereinabove. About 0.80 wt. % of other additives such as a pour point depressant were also present in the lubricant composition.

EXAMPLE 2

The same as Example 1 with the exception that it did not contain the BZT/TCP reaction product but contained 0.5 wt. % TCP and no BZT.

EXAMPLE 3

The same as Example 1 with the exception that it did not contain the BZT/TCP reaction product or unreacted BZT or TCP in any form.

Example 1 which contains the BZT/TCP calcium sulfonate calcium phenate additives in accordance with this invention was thereafter evaluated for various performance characteristics; see Table 1. Examples 2 and 3, as described above are not in accordance with this invention, were directly compared with Example 1 as to their non-ferrous corrosion protection; see Table 2. The test conditions for each were identical. Example 1 containing the BZT/TCP calcium di-nonyl naphthalene sulfonate/calcium alkyl phenate additive package was clearly superior to Examples 2 and 3 which did not contain said novel additive combination.

The base stock utilized in the test procedures described below was a typical solvent refined paraffinic neutral base stock.

TABLE 1

PERFORMANCE TEST DATA

| Performance Properties | Specific Test | Example 1 |
|---|---|---|
| 1. Multimetal Compatibility | A. Bronze/Steel Clutch Machine Test[A] | Pass |
| | B. Bronze/Aluminum/Steel Gear Pump Test[A] 3000 psi, 3000 rpm | No metal distress; No flow reduction |
| | C. Bronze/Steel Axial Piston Pump Test[A] 5000 psi, 3200 rpm | No metal distress; No flow reduction |
| | D. Copper/Steel Corrosion Bench Test[A] 1 week at 275° F. | Pass |
| 2. Antiwear Protection | Vane Pump Test[1] 2000 psi, 1200 rpm Wear, mg | 17 |
| 3. Rust Protection | Salt Water Rust Test[2] | Pass |
| | E. Thin Oil Film Inhibition Hours Rust-Free Life | 120 |
| 4. Keep-Clean Performance | F. Vane Pump Test (Hydraulic Fluid Durability) 1600 psi, 1440 rpm Hours to Deposit Formation | 1250 |

[A]Procedure outlined infra
[1]ASTM D2882
[2]ASTM D665, Procedure B

TABLE 2

NON-FERROUS CORROSION PROTECTION

| Formulation | Example 3 | Example 2 | Example 1 |
|---|---|---|---|
| Copper/Steel Corrosion Bench Test* | | | |
| Copper Rod Condition | Black, heavy corrosion | Black, heavy corrosion | Clean, no corrosion |
| Copper Removed, milligrams** | 22.5 | 20.9 | 2.1 |
| Steel Rod Condition | Clean, no corrosion | Clean, no corrosion | Clean, no corrosion |

*See Test Procedure D, page 11
**Must be less than 10 milligrams

The test procedures used in Tables 1 and 2 (except for those having ASTM designations) are as follows (note that data derived from Procedure D appears in both tables):

TEST PROCEDURES

A. Bronze/Steel Clutch Machine Test

Cincinnati Milacron Company performed the test over a 3-month test period, but does not disclose the specific test procedure. Cincinnati Milacron Company confirmed our evaluation and stated that the oil was in like-new condition at the end of the test. These machines used the same fluid for the hydraulic system and the heavy-duty bronze-on-steel clutches of the speed changer. Surface temperatures on these clutches may reach as high as 500° to 800° F. Lubricant decomposition products formed and left on a clutch tend to glaze the clutch plates and cause servo-valve malfunction. Fluids containing additives in accordance with this invention exhibited none of these problems.

B. Procedure For Gear Pump Test

I. Object

To determine performance of a hydraulic oil in a gear pump which is a low cost, high performance pump.

II. Outline

An aluminum-body gear pump is operated at high pressure and constant speed, e.g., 3300 rpm/3000 psi. After about 100 hrs., the pump is removed and disassembled and internal parts inspected. The internal parts are examined for:

Cavitation of aluminum housing; gear tooth wear; bronze side-plate corrosion or wear; and the condition of copper bearing surface where gear shaft rotates. Flow rate in gallons/minute is monitored during the test. Flow rate decrease of between 5 to 10% is failure criterion.

C. Procedure For Axial Piston Pump Test

I. Object

To determine the performance characteristics of hydraulic fluids with an Axial Piston Pump.

II. Outline

A variable displacement axial piston pump is driven at 3200 rpm by either a 200 or 300 hp electric motor through a variable speed drive. Test fluid (16.5 gal) with 1% distilled water added is circulated for 200 hours at 5000 psi. The pump stroke is set at ½ of maximum (about 25 gpm). At the end of test, the pump soaks on the test stand for about 24 hours before being removed.

The main pump circuit contains only a heat exchanger and a flow meter; there is no filter in the main loop.

The pump case drain (fluid which "blows by" pistons and from porting surfaces) passes through a heat exchanger, then into the reservoir. From the reservoir, the fluid passes through a 10μ filter before entering the charge pump (which is located on the test pump and driven by the test pump drive shaft).

A portable combination pump/filter unit with a 0.6μ filter is used to fill the hydraulic system.

D. Thermal Stability Test—Copper Steel Corrosion Test

I. Object

To test the stability of industrial lubricating oils at elevated temperatures in contact with steel and copper rods.

II. Outline

A copper rod and a steel rod are weighed and immersed in the sample which is then heated to 135° C. for 168 hours. The rods are removed and rated by visual examination according to the ASTM Copper Strip Corrosion Standards (ASTM D130) and/or other corrosion standards. The rods are rinsed and weighed, treated to remove lacquer deposits and reweighed to determine the weight of lacquer and the loss of weight during the test.

The oil is filtered through filter paper and through an 0.8-micrometer membrane filter and the weight of residue on each filter is determined and reported. The filtered oil is tested for change in viscosity and in neutralization number.

III. Apparatus

Copper Test Rods, 0.25 inch diameter by 3.0 inches long. Specify ASTM B-133, "Tough Pitch Copper," Copper Development Association Alloy No. 110 Electrolytic Copper (99.92% Cu).

E. TOFI (Thin Oil Film Inhibition)—Battery Jar Rust Test

I. Object

To test industrial lubricating oils for rust inhibiting ability when present as a thin film on steel surfaces.

II. Outline

A steel test panel is coated with a thin film of the oil and supported above a water bath at 140° F. (60° C.). After 3 hours the panel is removed and examined for rusting.

III. Apparatus

Test Panels. Low carbon cold rolled steel; specify Type MIL-L-46002, conforming to Specification QQ-S-640. Battery Jar Test Bath, 8¾ in. O.D.X. 10 in. high. Battery Jar Cover. Hot Plate, 8 in. diameter. Thermometer, 0°–220° F. Sandblasting Equipment.

F. Vane Hydraulic Fluid Durability Test Procedure

I. Object

To evaluate the durability characteristics of hydraulic fluids in a vane type pump.

II. Outline

A fixed displacement vane pump rated at 22 gpm with new weighed components, circulates a fixed volume of hydraulic fluid under controlled conditions of temperature and pressure. The pump flow rate, pressure and inlet fluid temperature is monitored. Typical test duration is 1500 hours or until the hydraulic system filter reaches a prescribed varnish rating. During interim and final inspections, pump components are weighed and system components are visually rated and photographed.

III. Equipment Description

The pump is an intermediate series, fixed displacement, hydraulically balanced, vane type pump. At 1200 rpm and 0 psi the pump displaces 22.3 gpm.

Preferred embodiments have been exemplified, however, it is understood by those of ordinary skill in the art that variations and departure within the scope of this invention may be readily made.

We claim:

1. An antiwear additive having multimetal compatibility which concommitantly provides corrosion control, rust protection and improved cleanliness and is readily soluble in oils of lubricating viscosity comprising (A) the reaction product of benzotriazole and tricresyl phosphate and (B) the combination consisting of calcium dinonyl naphthalene sulfonate and calcium alkyl phenate.

2. The additive of claim 1 wherein benzotriazole/tricresyl phosphate adduct is prepared by reaction under suitable reaction conditions with about 3–6 wt. % benzotriazole and 94–97 wt. % tricresyl phosphate based on the total weight of the reaction mixture.

3. The additive of claim 2 wherein the amount of benzotriazole is about 4 wt. % and the amount of tricresyl phosphate is about 96 wt. %.

4. The additive of claim 1 wherein the ratio of calcium dinonyl naphthalene sulfonate to calcium alkyl phenate is from about 1:1 to about 9:1 with the proviso that the ratio of sulfonate to phenate is at least 1:1.

5. The additive of claim 1 wherein the concentration or ratio of component A to component B is from 0.5–1.5 to 1.0 wt. %.

6. An oleaginous composition comprising a major amount of an oil of lubricating viscosity and a minor effective antiwear amount of a lubricant additive package as described in claim 1.

7. The composition of claim 6 wherein the oil of lubricating viscosity is selected from hydraulic oils or fluids, power steering fluid, brake fluid and transmission fluid.

8. The composition of claim 7 wherein the oil of lubricating viscosity is a hydraulic oil or fluid.

9. The composition of claims 6 or 8 wherein the oil of lubricating viscosity is a synthetic oil.

10. The composition of claims 6 or 8 wherein the oil of lubricating viscosity is a mineral oil.

* * * * *